US009027252B2

(12) United States Patent
Moseman

(10) Patent No.: US 9,027,252 B2
(45) Date of Patent: May 12, 2015

(54) LOW RESISTANCE HAIR CLIPPER BLADE TOOTH PROFILE

(75) Inventor: Russell L. Moseman, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 503 days.

(21) Appl. No.: 12/727,863

(22) Filed: Mar. 19, 2010

(65) Prior Publication Data

US 2011/0225830 A1 Sep. 22, 2011

(51) Int. Cl.
*B26B 19/02* (2006.01)
*B26B 19/00* (2006.01)
*B26B 19/38* (2006.01)

(52) U.S. Cl.
CPC ..... *B26B 19/3846* (2013.01)

(58) Field of Classification Search
CPC ..... B26B 19/02; B26B 19/06; B26B 19/20; B26B 19/22
USPC ..... 30/43.91, 43.92, 42, 44, 45, 208–210, 30/220, 222, 225, 355
See application file for complete search history.

(56) References Cited

U.S. PATENT DOCUMENTS 518,204 A 4/1894 Bell et al.
1,563,332 A 12/1925 Bristow
1,567,110 A 12/1925 Bristow
2,024,915 A 12/1935 Dufty
2,210,703 A 8/1940 Bristow
3,934,340 A 1/1976 Jones et al.
3,999,295 A * 12/1976 Du Bois ..... 30/195
4,118,863 A * 10/1978 Sandy ..... 30/195
4,592,143 A 6/1986 Pizzuto et al.
4,825,546 A 5/1989 Araki et al.
5,237,750 A 8/1993 Nakano et al.
5,367,772 A 11/1994 Ogawa
5,579,581 A 12/1996 Melton
5,600,890 A * 2/1997 Leitner et al. ..... 30/223
5,964,037 A 10/1999 Clark
6,073,350 A 6/2000 Elston et al.
6,178,641 B1 1/2001 Meijer
6,502,312 B2 1/2003 Beutel et al.
6,962,000 B2 11/2005 Teeuv et al.
6,973,855 B2 12/2005 Yanosaka et al.
6,986,206 B2 1/2006 McCambridge et al.
7,080,458 B2 7/2006 Andis

FOREIGN PATENT DOCUMENTS

GB 415455 8/1934

* cited by examiner

*Primary Examiner* — Kenneth E. Peterson
*Assistant Examiner* — Samuel A Davies
(74) *Attorney, Agent, or Firm* — Greer, Burns & Crain, Ltd.

(57) ABSTRACT

A tooth for a blade of a hair cutting apparatus includes a root secured to a base of the blade, a tip opposite the root, and a longitudinal axis of the tooth defined between the root and the tip. A lower, planar cutting surface is provided on the tooth, as is an upper surface opposite the lower surface, and sidewalls separating the upper surface from the lower surface. At least a portion of the upper surface and the sidewalls is elliptical in the direction of the longitudinal axis, beginning at the tip.

11 Claims, 4 Drawing Sheets

LOW RESISTANCE HAIR CLIPPER BLADE TOOTH PROFILE

BACKGROUND

The present invention relates generally to hair cutting devices, also referred to hair clippers or hair trimmers employing reciprocating blade action for achieving cutting action, here collectively referred to as hair clippers, more specifically to blades for such clippers, and more particularly to the specific configuration of teeth for such blades.

Conventionally, clipper blades include a stationary or fixed blade, and a moving blade that reciprocates under a drive force relative to the fixed blade. Each blade has a generally planar base, which in the stationary blades is often provided with fastener openings for accommodating fasteners that secure the blade to the clipper. The moving blade is typically clamped against the fixed blade by a spring clip and includes a generally central opening for receiving a drive member.

Common edges of the fixed and moving blades are provided with a plurality of cutting teeth. Depending on the type of cutting action desired, and the target subject to be clipped, including humans, livestock, pets, carpet, etc., the tooth length and configuration may vary, but in most cases the teeth have a box-like transverse cross-section. This cross-sectional configuration extends from a root of the tooth adjacent the base, to an opposing tooth tip. In many cases, tips of the teeth are initially finished using conventional grinding and polishing techniques to remove sharp edges on the corners. A planar surface is formed along a lower tooth surface, forming the cutting surface. Also, many conventional blades are subjected to secondary finishing that applies a radius between the sides and the cutting surface. Despite this finishing, teeth on conventional blades are typically formed of a plurality of planar surfaces.

SUMMARY

An improvement in the above-identified conventional blade tooth profile is provided that has been found to significantly improve the cutting operation of hair clippers. In fact, by replacing conventional blades with blades having teeth configured as described below, the feed rate of hair through a hair clipper bladeset has been improved by a factor of several times, the amount of improvement depending on the density of the material being cut and the particular blade configuration. In some cases, an increase by as much as ten times the conventional feed rate was obtained using the present blade tooth configuration. Also, the quality of the cut increases significantly, and a given clipper equipped with the present blades is capable of superior cutting and fiber (hair) feeding compared to the same clipper equipped with conventional blades.

Another feature of the present blade tooth is an elliptical transition zone on the tooth tip, forming a three-dimensional feed enhancing shape. Thus formed, the tooth tip lacks a planar surface except for the cutting surface. In a preferred embodiment, the arc defined in the axial or Y direction of the tooth is greater than that of the transverse or X direction, creating an elliptical shape. In some applications, it is contemplated that the dimensions of the arc of the Y direction will be as much as three times that of the X direction.

More specifically, a tooth for a blade of a hair cutting apparatus includes a root secured to a base of the blade, a tip opposite the root, and a longitudinal axis of the tooth defined between the root and the tip. A lower, planar cutting surface is provided on the tooth, as is an upper surface opposite the lower surface, and sidewalls separating the upper surface from the lower surface. At least a portion of the upper surface and the sidewalls are elliptical in the direction of the longitudinal axis, beginning at the tip.

In another embodiment, a cutting blade for use in a hair cutting apparatus is provided, including a base having a first edge and an opposite second edge, a plurality of teeth projecting from the first edge, the teeth each defining a longitudinal axis between a root secured to the first edge and a tip opposite the root. Each of the teeth is provided with a lower, planar cutting surface, and opposite upper and sidewall surfaces. A cross-section taken of each of the teeth in a plane defined by the tip and being at least one of parallel to the planar cutting surface and perpendicular to the cutting surface and extending along the longitudinal axis defining an ellipse.

DETAILED DESCRIPTION

Figure 1:
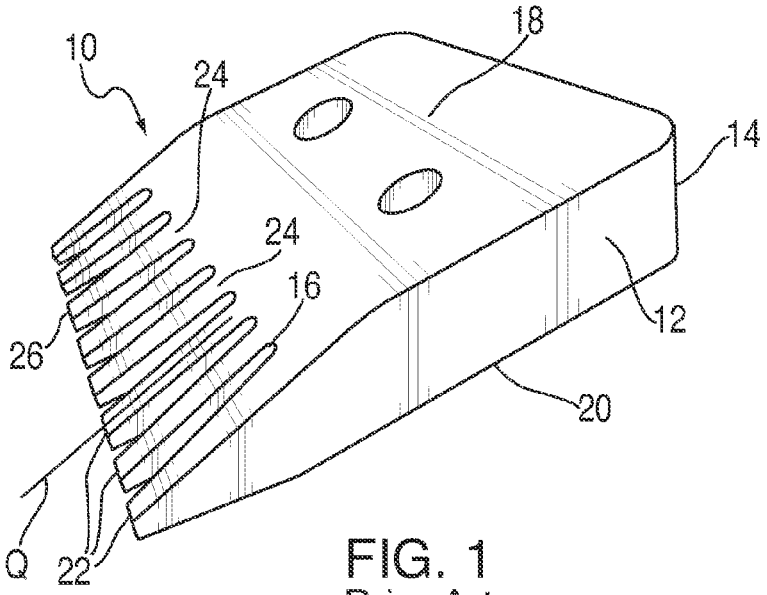
FIG. 1 Prior Art
FIG. 1 is a top perspective schematic view of a prior art stationary clipper blade.
Figure 2:
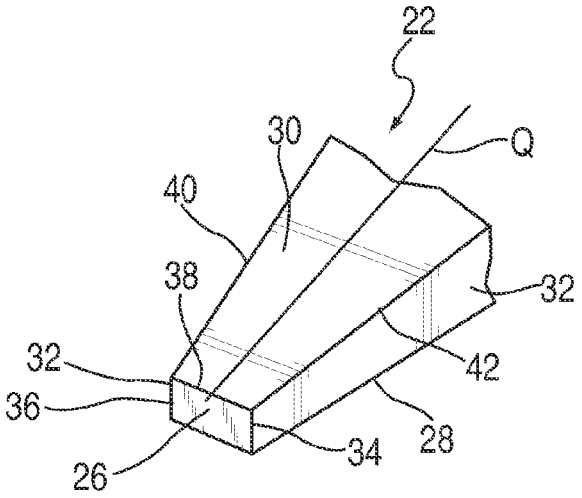
FIG. 2 Prior Art
FIG. 2 is an enlarged fragmentary top perspective view of a tooth of the clipper blade depicted in FIG. 1.

Referring now to FIGS. 1 and 2, a conventional or prior art hair clipper blade is schematically illustrated and generally designated 10, and includes a generally planar base 12 having a first or rear edge 14 and an opposite second or front edge 16. An upper surface 18 is seen by the user when the blade 10 is mounted to a hair clipper as is well known in the art, and an opposite lower surface 20 faces the clipper housing (not shown). It is to be understood that the blade 10 may have a variety of shapes, as is known in the art, and the depiction in FIG. 1 is for reference purposes only. The present focus is on the construction of the teeth.

A plurality of clipper teeth 22 project from the second edge 16 and each has a root 24 secured to the second edge, and an opposite tip 26. In the present application, the tip 26 refers to the end or distal region of the tooth 22, and is not restricted to its endpoint. Reference number 26 thus also refers to a tip area. Each tooth 22 defines a longitudinal axis 'Q' between the root 24 and the tip 26. It will be seen from FIG. 2 that each tooth 22 has a transverse cross-section that is box-shaped, defined here to mean rectangular, square, trapezoidal or otherwise quadrilateral. However, other polygonal shapes having planar surfaces are also known in the art for tooth cross-sections. A planar cutting surface is found at 28, on a lower surface of the tooth 22. Opposite the cutting surface 28 is an upper tooth surface 30 and sidewalls 32 separating the cutting surface from the upper tooth surface. The upper tooth surface 30 and the sidewalls 32 are also planar. Note that the conventional tooth 22 has several sharp corners, approximately forming right angles at edges 34, 36 and 38 defining the tip 26, and edges 40 and 42 separating the upper surface 30 from the sidewalls 32.

Figure 3:
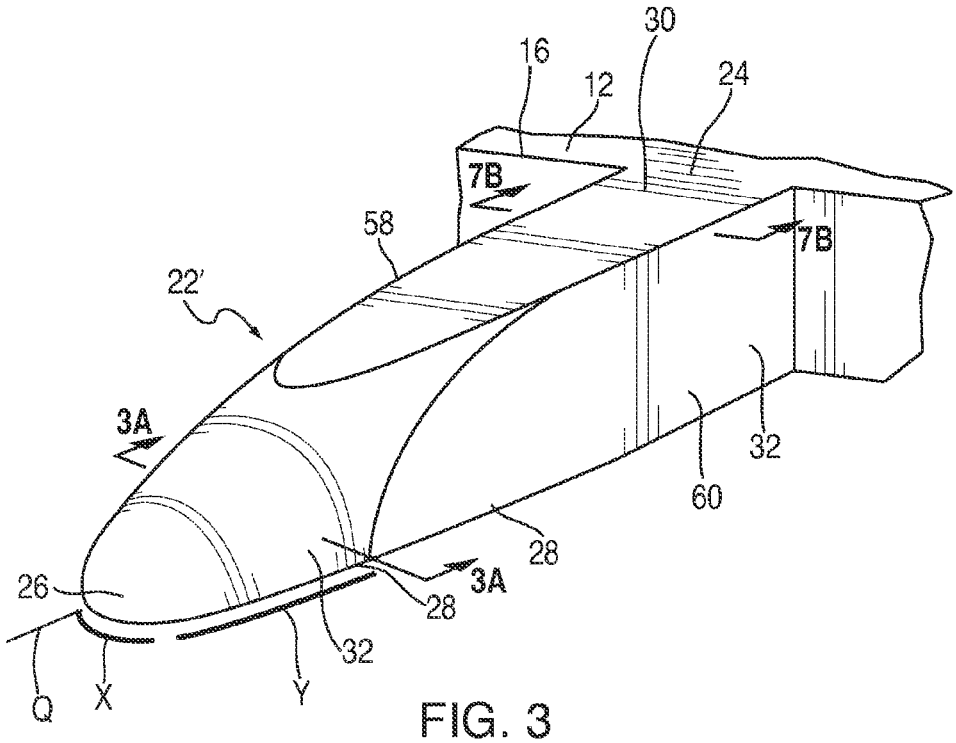
FIG. 3 is a fragmentary top perspective view of the present blade equipped with the present tooth.
Figure 4:
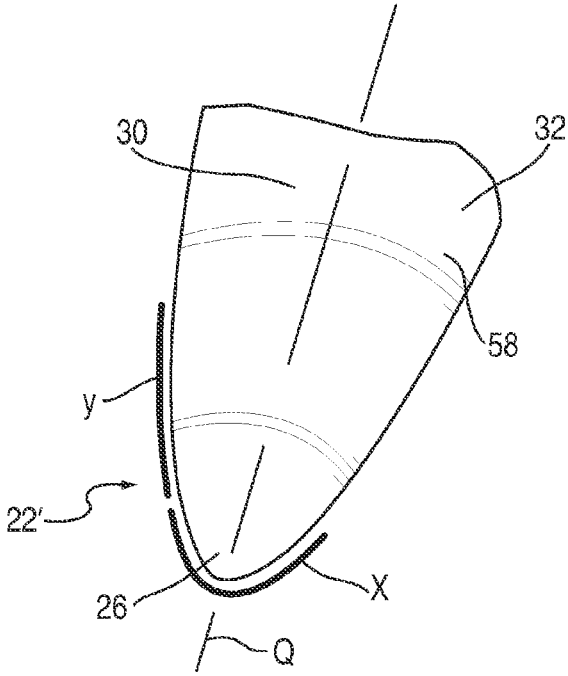
FIG. 4 is an enlarged fragmentary perspective view of the tooth depicted in FIG. 3.
Figure 5:
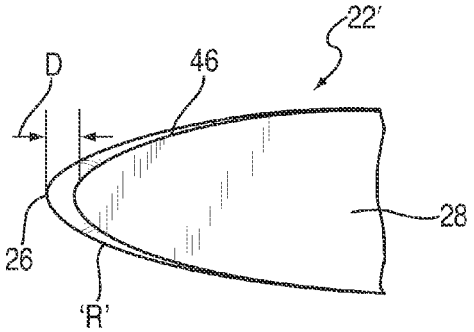
FIG. 5 is a fragmentary bottom plan view of an alternate embodiment of the present tooth.
Figure 6:
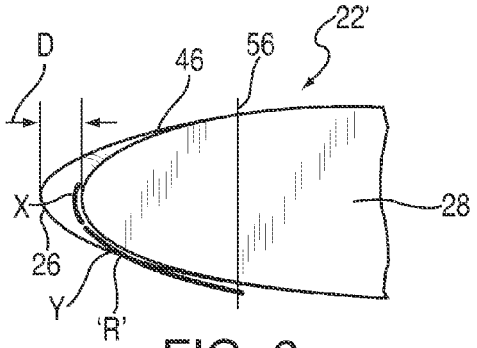
FIG. 6 is a fragmentary bottom plan view of another alternate embodiment of the present tooth.
Figure 7:
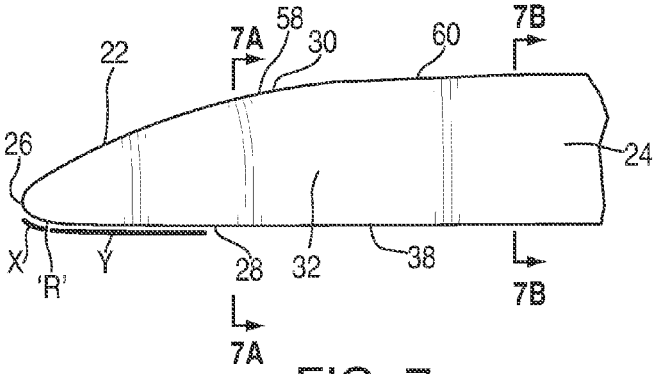
FIG. 7 is a fragmentary side elevation of the tooth of FIG. 5.

Referring now to FIGS. 3-8, the present tooth is shown and generally designated 22'. Shared components with the tooth 22 are designated with identical reference numbers. Tests by the inventor have shown that removal of right angles along edges 34, 36, 38, 40 and 42 and reconfiguration of the tooth 22' to have a totally nonplanar periphery, with the exception of the lower tooth surface 28 forming the planar cutting surface, provides improved cutting performance. An important feature of the present blade tooth 22,' is that at least a portion of each of the upper surface 30, and also preferably the sidewalls 42, are elliptical in the direction of the longitudinal axis 'Q' beginning at the tip 26. It is preferred that the tip 26 on the blade 22' defines an arc 'X' transverse to the longitudinal axis 'Q', and at least a portion of the longitudinal axis 'Q' defines an arc 'Y', such that Y>X, thus forming the elliptical shape (FIGS. 4-6). It is also preferred that the transition between adjacent ends of the arcs X and Y is smooth. Another feature is that the arcs 'X' and 'Y' are preferably measured in at least two planes, one parallel to the cutting surface 28 (FIGS. 4 and 6), and another perpendicular to the cutting surface and aligned with the longitudinal axis 'Q' (FIG. 7). In addition, it is particularly preferred that the arc 'Y' encompasses less than or equal to ⅓ the longitudinal axis 'Q' beginning at the tip 26. However, it is contemplated that the length of the arc 'Y' may vary to suit the application, and may exceed ⅓ the longitudinal axis 'Q'.

Referring now to FIGS. 3 and 4, it is contemplated that the arcs 'X' and 'Y' define an elliptical shape through 'Y' being greater than 'X'. Such a shape has been found to significantly increase the feed rate of hair through a clipper equipped with at least one blade provided with the present teeth 22'. In the preferred tooth 22', the nonradial or elliptical arc 'Y' is formed into a tooth configuration such that the sidewalls 32 are also elliptical and the only planar surface of the tooth 22' is the cutting surface 28. Thus, at the tip 26, transitions between the upper surface 30 and the sidewalls 32 are corner-free.

Figure 3A:
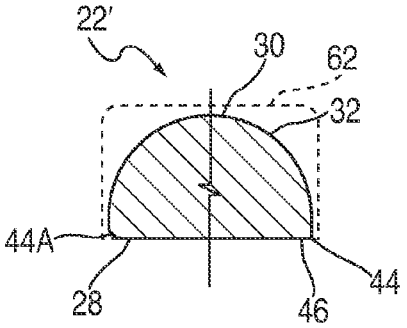
FIG. 3A is a composite cross-section taken along the line A'-A' of FIG. 3 and on the right side in the direction generally indicated, on the left side in the reverse direction.

As seen in FIGS. 3 and 3A, a first cross-section 7B-7B transverse to the longitudinal axis 'Q' taken near the root 24 is box-shaped; and a similar, second cross-section 3A-3A taken near the tip 26 is generally "D"-shaped, with a sole straight line being defined by the lower, cutting surface 28, and the remaining surfaces being elliptical. As is known in the art, the cutting action of a hair clipper bladeset is obtained at the side edges of the blade teeth, which create a scissors action as the moving blade reciprocates relative to the fixed blade. To preserve this cutting action, it is preferred that the cross-section 3A-3A of the tooth 22' and looking toward the root 24 has a corner 44 forming a sharp cutting edge where the planar cutting surface 28 transitions with the sidewall 32. This is seen on the right side of FIG. 3A.

However, to enhance the ability of the present blade 22' to feed through the hair, it is preferred that the looking from line 3A-3A towards the tip 26, (seen on the left side of FIG. 3A), the corner 44A is radiused. As such, it will be appreciated that no cutting action will occur from line 3A-3A towards the distal end of the tip 26.

Referring now to FIGS. 3A and 5-7, extending the concept of the radiused shape of the corner 44A, optionally, in some applications, a peripheral edge 46 of the lower, cutting surface 28 is also radiused or smoothly transitioned at 'R' so that there is no corner defined between the cutting surface and the sidewalls 32 at the tip 26. This transition area 'R' blends smoothly into the planar cutting surface 28. It is especially preferred that the radiused transition area 'R' is restricted to the tooth tip 26, however it is also contemplated that the transition area 'R' extends toward the tooth root 24 along the peripheral edge 46.

Comparing FIGS. 5 and 6, it will be seen that the transition area 'R' may vary and define a relatively smaller tip distance 'D' in FIG. 5, or a relatively larger tip distance 'D' in FIG. 6.

Figure 7A:
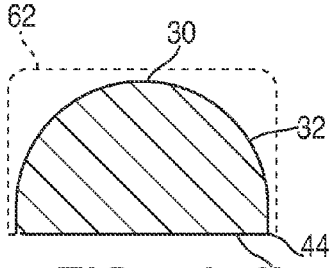
FIG. 7A is a cross-section taken along the line 7A-7A of FIG. 7 and in the direction generally indicated.
Figure 7B:
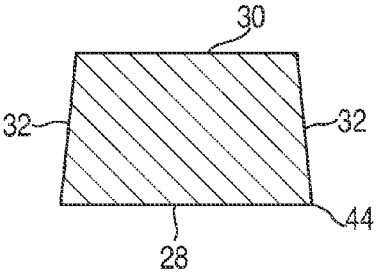
FIG. 7B is a cross-section taken along the line 7B-7B of FIGS. 3 and 7 and in the direction generally indicated.

Referring now to FIGS. 7, 7A and 7B, a gradual, smooth transition 'T' is formed between the first cross-section 7A-7A and the second cross-section 7B-7B on the tooth 22'. In other words, the transverse cross-section of the tooth 22' smoothly transitions from a nonplanar, curved shape near the tip 26 as seen in FIG. 7A, to a box shape with planar upper surface 30 and sidewalls 32 as seen in FIG. 7B near the root 24.

Figure 8:
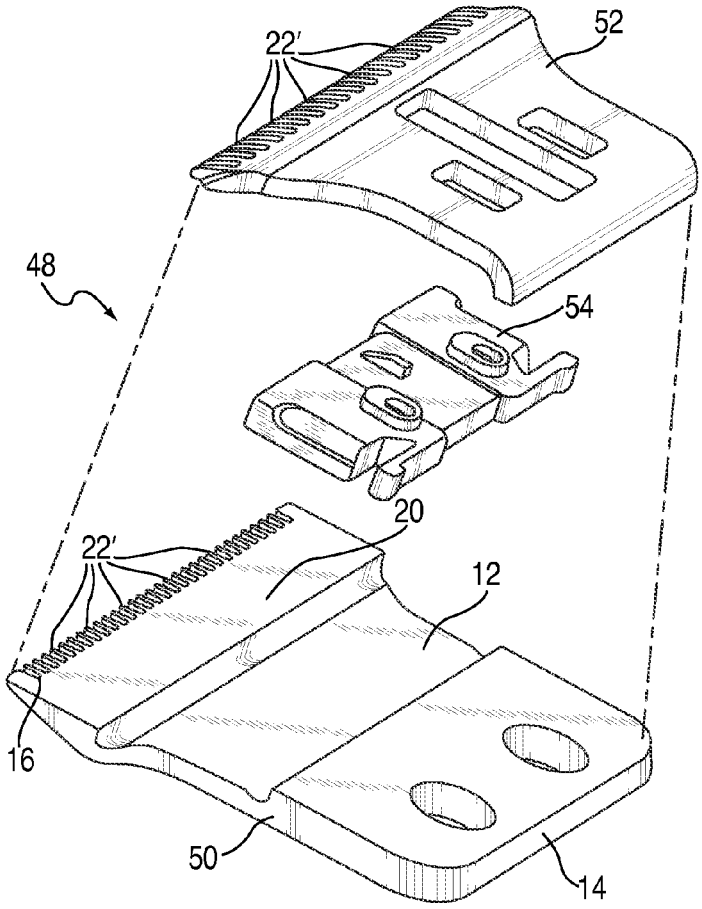
FIG. 8 is an exploded perspective view of the present bladeset provided with the present tooth configuration.

Referring now to FIG. 8, in practice, after viewing hair clipper blade action, it was found that hair fiber is impeded in its flow through the bladeset by sharp corners of the type found in conventional blade tooth geometries. More specifically, the abrupt geometry of existing tooth configurations causes a pressure spike at the point of contact with the hair fiber, which dramatically increases drag. Accordingly, this drag results in slower cutting speeds and lower overall cut quality. Further, while conventional blade teeth are commonly subjected to secondary finishing or lapping which rounds some corners or edges, they still have multiple planar surfaces.

It has been found that the removal of the right angles or corners at the edges 34-42 has resulted in significantly increased hair feed rates through a bladeset 48 made up of a fixed or stationary blade 50 and a complementary moving blade 52, at least one of which being equipped with the present teeth 22'(FIG. 8). Such a bladeset 48 is typically equipped with a blade guide 54 as is known in the hair clipper art. Referring briefly to FIG. 6, to obtain the desired scissors-type cutting action, the teeth of the moving blade 52 will define a line 56 on the cutting surface 28.

Cutting rates in the order of 5 to 10 times faster than standard "cornered" blades with planar upper and sidewall surfaces have been achieved with at least the stationary blade 50 provided with the present teeth 22'. In addition, the blade 52 may also be equipped with the teeth 22', as long as the stationary blade 50 is provided with such teeth. The main performance advantages of the present teeth 22' are achieved when formed on the stationary blade 50. It has also been found that cutting efficiency improves with the present teeth 22', such that fewer passes are required by the user working with the clipper on a certain area of a subject's head. Thus, a clipper equipped with blades 50, 52 at least the blade 50 having the present teeth 22' often performs at a level of a much more expensive clipper.

Table 1 below provides a comparison of blade feed rates between standard clipper blades and the present blade having teeth 22':

Synthetic Hair Cutting Test

This test measured the time in seconds taken to move three sample blade sets (A, B and C) of each configuration through a specified density of artificial hair arrayed along a specified distance, for example in the range of 20-24 inches long.

TABLE 1

| | Stock blade | | | Present blade | | |
|---|---|---|---|---|---|---|
| | 1 | 2 | 3 | 1 | 2 | 3 |
| A | 14.47 | 6.61 | 6.33 | 2.36 | 2.36 | 1.78 |
| B | 15.28 | 12.5 | 5.65 | 2.45 | 2.38 | 1.74 |
| C | 28.55 | 6.56 | 5.99 | 2.37 | 2.29 | 1.79 |

Averaging the above results, the present blade cut approximately five times faster than the stock blade.

Referring again to FIGS. 3A, 4, 7A and 7B, the present tooth 22' configuration has three distinct areas: a transition zone 58, a main body 60 and the tip 26. Preferably, the main body 60 is shaped as a result of blanking, milling or grinding operations and as a result is box-shaped in cross-section, with planar surfaces. The transition zone 58 provides a smooth change in configuration from the tip 26 to the main body. It will be seen in FIGS. 3A and 7A the amount of material removed from a standard blade tooth, shown in profile by the phantom lines 62. It is contemplated that the tip 26 is either spherical or bullet-nosed.

It is contemplated that the present blades, 50, 52 having the present teeth 22' can be shaped so that the teeth have the desired profile using any of the following, well-known machining, dressing and finishing technologies, including but not limited to abrasive media tumbling, abrasive drag finishing, rubberized abrasives, buffing wheels, abrasive polishes, as well as other known grinding, polishing, buffing and machining technologies.

Thus, it will be seen that providing a cutting blade 50 having teeth 22' produced with a tip area 26 that lacks planar surfaces except for the cutting surface results in hair feed rates significantly faster than conventional clipper blade sets.

While a particular embodiment of the present low resistance hair clipper blade tooth profile has been shown and described, it will be appreciated by those skilled in the art that changes and modifications may be made thereto without departing from the invention in its broader aspects and as set forth in the following claims.

What is claimed:

1. A tooth for a blade of a hair cutting apparatus, said tooth comprising:

a root secured to a base of the blade and having four flat sides;

a tip opposite said root, a longitudinal axis of said tooth defined between said root and said tip;

a lower, planar cutting surface having a peripheral edge with an arcuate portion;

an upper surface opposite said lower surface;

generally parallel and generally planar sidewalls separating said upper surface from said lower surface near said root;

at least a portion of said upper surface and said sidewalls being a portion of an ellipse in the direction of said longitudinal axis beginning at said tip and terminating at said root, a cross-section taken near said tip is "D"-shaped, with a sole straight line being defined by said lower, planar cutting surface;

a radiused transition area defining a tip distance between said lower planar cutting surface and said upper surface at said tip such that said transition area blends smoothly into said planar cutting surface, wherein a distance from said tip of tooth to said root is greater than a distance from a distal end of said peripheral cutting edge to said root.

2. The tooth of claim 1 wherein said arcuate portion of said peripheral edge encompasses less than or equal to ⅓ said longitudinal axis beginning at said tip and ending at said root.

3. The tooth of claim 1 further including a gradual, smooth transition of a transverse cross-section of said tooth between a first cross-section transverse to said longitudinal axis of said tooth taken near said root and a similar, second cross-section taken near said tip.

4. The tooth of claim 1 wherein a peripheral edge of said lower surface at said tip is radiused to form a transition with said sidewalls.

5. The tooth of claim 1 further including a first region near said tip being corner-free, and a second region near said root having corners.

6. A cutting blade for use in a hair cutting apparatus, comprising:

a base having a first edge and an opposite second edge;

a plurality of teeth projecting from said second edge, said teeth each defining a longitudinal axis between a root secured to said first edge and a tip opposite said root;

each of said teeth provided with a lower, planar cutting surface having a peripheral edge with an arcuate portion, an upper surface opposite said lower surface, and generally parallel and generally planar sidewall surfaces near said root;

a first cross-section taken of each of said teeth including said tip, in a first plane being parallel to said planar cutting surface, a second D-shaped cross section taken at each of said teeth near said tip in a second plane being perpendicular to said cutting surface and extending from an upper tooth surface to said planar cutting surface defining a portion of an ellipse, and a third cross-section taken at said root having four flat sides and a gradual, smooth transition between said second cross-section at a third plane and said third cross-section at said root; and a radiused transition area defining a tip distance between said lower, planar cutting surface and upper surface at said tip such that said transition area blends smoothly into said planar cutting surface, wherein a distance from said tip of tooth to said root is greater than a distance from a distal end of said peripheral cutting edge to said root.

7. The blade of claim 6 wherein said arcuate portion of said peripheral edge encompasses less than or equal to ⅓ said longitudinal axis beginning at said tip and ending at said root.

8. The blade of claim 6 wherein a transition between adjacent ends of the arcs 'X' and 'Y' is smooth.

9. The blade of claim 6 wherein an upper surface of said tooth along said longitudinal axis defines an elliptical arc.

10. The blade of claim 6 wherein a peripheral edge of said lower surface at said tip is radiused to form a transition with said sidewalls.

11. The blade of claim 6 further including a first region near said tip being corner-free, and a second region near said root having corners.

* * * * *